United States Patent [19]

Yelczyn

[11] Patent Number: 4,890,552

[45] Date of Patent: Jan. 2, 1990

[54] CAN CRUSHER

[76] Inventor: Lawrence Yelczyn, W6630 County Trunk E, Burnett, Wis. 53992

[21] Appl. No.: 284,738

[22] Filed: Dec. 15, 1988

[51] Int. Cl.[4] ..... B30B 7/00; B30B 1/02

[52] U.S. Cl. ..... 100/233; 100/258 A; 100/283; 100/293; 100/902

[58] Field of Search ..... 100/902, 233, 258 A, 100/280, 281, 283, 293, 295; D15/123

[56] References Cited

U.S. PATENT DOCUMENTS

| | | | |
|---|---|---|---|
| D. 282,076 | 1/1986 | Taylor | 100/902 X |
| 4,088,072 | 5/1978 | Wittmeier | 100/283 |
| 4,290,354 | 9/1981 | Stevens | 100/283 X |
| 4,459,908 | 7/1984 | Sierk | 100/293 X |
| 4,498,385 | 2/1985 | Manley | 100/233 |

*Primary Examiner*—Harvey C. Hornsby

*Assistant Examiner*—Stephen F. Gerrity

*Attorney, Agent, or Firm*—Donald Cayen

[57] ABSTRACT

A can crusher comprises a bottom plate and a handle that rotate about a first axis. A top plate is slidable along the handle. A link pivotally connects the top plate to a second axis offset from the first axis. Rotating the handle and bottom plate tends to revolve the top plate away from the second axis, but the link keeps the top plate at a fixed distance from the second axis by controlling the top plate to slide along the handle toward the bottom plate. A can or other object placed between the top and bottom plates is crushed between them as the handle rotates. The handle normally rotates from a vertical attitude toward a horizontal attitude during the crushing operation. The handle and bottom plate can rotate to a stable rest configuration below the first axis.

14 Claims, 2 Drawing Sheets

CAN CRUSHER

BACKGROUND OF THE INVENTION

1. Field of the Invention

This invention pertains to crushing equipment, and more particularly to apparatus for crushing recyclable materials.

2. Description of the Prior Art

An increased awareness has developed in recent years concerning the problems associated with waste materials. Both environmental and economic factors have contributed to change traditional methods of waste disposal. In particular, recycling scrap materials has become increasingly common.

Aluminum is an especially valuable material that lends itself quite readily to recycling. The common beverage can is a significant source of recyclable aluminum. It is well known to compact aluminum beverage cans in order to conserve space throughout the recycling process. Equipment and methods for compacting the cans vary from stomping with a person's foot to sophisticated coin dispensing shredders.

U.S. Pat. Nos. 2,446,898; 4,197,796; 4,323,009; 4,333,395; and 4,345,520 are illustrative of hand operated devices for crushing cans. The various devices of the foregoing patents operate to generally axially compress the cans. None of the crushers is entirely satisfactory. The crushers of the U.S. Pat. Nos. 2,446,898 and 4,333,395, for example, produce lateral forces as well as axial forces on the cans. It is therefore difficult to compact the cans into minimum volume. The compactor of the U.S Pat. No. 4,197,796 requires both horizontal and vertical mounting surfaces, thereby limiting the places where that compactor can be used.

U.S. Pat. No. 4,475,449 describes a compacting apparatus that applies a lateral force to the can midsection before the can is axially crushed. The two stage operation results in undesirable complexity and expense.

Thus, a need exists for an improved can crusher.

SUMMARY OF THE INVENTION

In accordance with the present invention, a crusher is provided that efficiently compacts selected objects into minimum volume slugs in an inexpensive and reliable manner. This is accomplished by apparatus that includes a top plate that slides toward a bottom plate while both plates rotate under the influence of a rotatable handle.

The bottom plate and handle are rotatable connected to a base member that is mounted to a solid surface. The bottom plate is fixed to the handle lower end approximately perpendicular thereto. The bottom plate and handle rotate in unison about a first axis defined by the base member. The crusher top plate is generally parallel to the bottom plate, and it is slidable along the handle. A link pivotally connects the top plate to the base member. The link has a first end pivotally received in the base member for pivoting about a second axis. The second axis is offset from the first axis. The link has a second end pivotally received in the top plate.

The crusher is operable between open and closed configurations. In the open configuration, the handle is in a first position, which may be generally vertical. With the handle in a generally vertical first position, the planes of the top and bottom plates are generally horizontal, and the top and bottom plates are vertically aligned. The vertical spacing between the top and bottom plates is sufficient to receive an object to be compacted therebetween. In the closed configuration, the handle is in a second position that may be generally horizontal, and the top and bottom plates are generally vertical and proximate one another.

Rotating the handle from the first to the second positions thereof causes the bottom plate to rotate about the first axis and also to move farther away from the second axis. The handle also moves away from the second axis. Rotation of the handle away from the second axis also causes the top plate to revolve about the first axis. Since the top plate is maintained at a fixed distance from the second axis by the link, rotation of the handle about the first axis and away from the second axis causes the top plate to slide along the handle toward the first axis and the bottom plate. The combination of the rotation of the bottom plate away from the second axis and the sliding of the top plate along the handle toward the bottom plate causes the two plates to approach each other and compact an object placed between the plates.

The components of the present invention are so designed that the object is substantially fully compacted when the crusher is in the closed configuration. From the closed configuration, a slight rotation of the handle back toward the first position thereof causes the plates to separate and release the crushed object, so that it falls without attention into a container waiting below. Rotating the handle completely to the first position thereof spreads the plates apart to the open configuration so another object can be inserted between them.

For safety reasons, the crusher is capable of attaining a rest configuration when the crusher is operated in a vertical plane. In the rest configuration, the handle and bottom plate are in respective locations substantially below those of the closed configuration, such that their centers of gravity are generally underneath the first axis. The plates are adjacent each other in the rest configuration. Consequently, the crusher is stable, and the danger of accidental operation from the open to the closed configurations is eliminated.

Other advantages, benefits, and features of the invention will become apparent to those skilled in the art upon reading the detailed description of the invention.

DETAILED DESCRIPTION OF THE INVENTION

Figure 2:
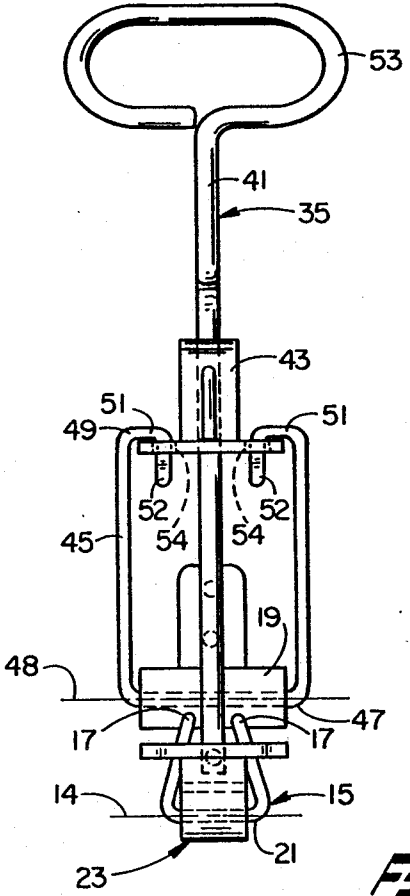
FIG. 2 is a front view of the crusher of FIG. 1.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to the drawings, a crusher 1 is illustrated that includes the present invention. The crusher is particularly useful for compacting aluminum beverage cans 3, but it will be understood that the invention is not limited to metal recycling applications.

The crusher is designed to be mounted to a sturdy surface by an L-shaped base member 7. The base member 7 is shown mounted to a vertical surface 5, but the crusher also works very well when mounted to a horizontal or an inclined surface. The base member 7, as well as the rest of the components of the crusher are preferably made of steel.

Vertical leg 9 of the base member 7 lies against the surface 5, where it is retained by conventional fasteners 11. the base member horizontal leg 13 extends a short distance outwardly from the vertical leg 9. The base member is fabricated with a shaft that defines a first axis 14. Preferably the shaft and axis 14 are embodied within a rod-like member formed into a generally U-shaped loop 15. The first axis 14 is defined by the loop closed end 21. The loop 15 has free ends 17 welded to the base member vertical leg. A journal 19, which may be in the form of an angle, is welded to the vertical leg, and the loop free ends 17 are welded to the angle. For added rigidity, the loop side legs 18 may be welded to the base member horizontal leg 13. In the illustrated construction, the plane of the loop lies approximately 60 degrees to the plane of the base member vertical leg. However, that angle is not critical.

Rotatably captured over the closed end 21 of the loop 15 is a generally V-shaped support 23. The support 23 is comprised of a first leg 29 and a second leg 31. The crook 25 of the support 23 is captured over the loop closed end 21 by a short retainer plate 27 welded between the two legs 29 and 31. To the free ends of the support legs 29 and 31 is welded a bottom plate 33.

A handle 35 is constructed with an elongated rod 36 having a lower end 37 that is welded to the support leg 29. The handle rod 36 is generally perpendicular to the plane of the bottom plate 33. The handle rod has a slightly angled upper section 41. The upper section 41 terminates in a hand grip 53. the handle 35, bottom plate 33, and V-shaped support 23 are rotatable together about the closed end 21 of the loop 15.

In the preferred embodiment, the crusher 1 further comprises a top plate 39 that has a hole therein for sliding along the handle rod 36. An L-shaped bracket 43 welded to the top plate 39 and having a hole therethrough provides stability for the top plate on the handle 35.

To control sliding of the top plate 39 along the handle 35, a link 45 is employed. One end 47 of the link 45 is captured in and is rotatable within the journal 19 that is welded to the base member vertical leg 9. In that manner, the journal 19 creates a second axis 48 about which the link end 47 pivots. The link opposite end 49 may be pivotally captured within an angle welded to the top plate 39. In the illustrated construction, the link second end 49 is formed with a pair of reverse bends 51 that terminate in respective free end sections 52. The end sections 52 of the reverse bends 51 pass through relatively large clearance holes 54 in the top plate. To positively retain the link end 49 in the top plate, the end sections 52 are bent at approximately 45 degrees to the plane of the link. Preferably, the 45 degree bends of the end sections are located approximately one quarter inch from the top plate.

Figure 1:
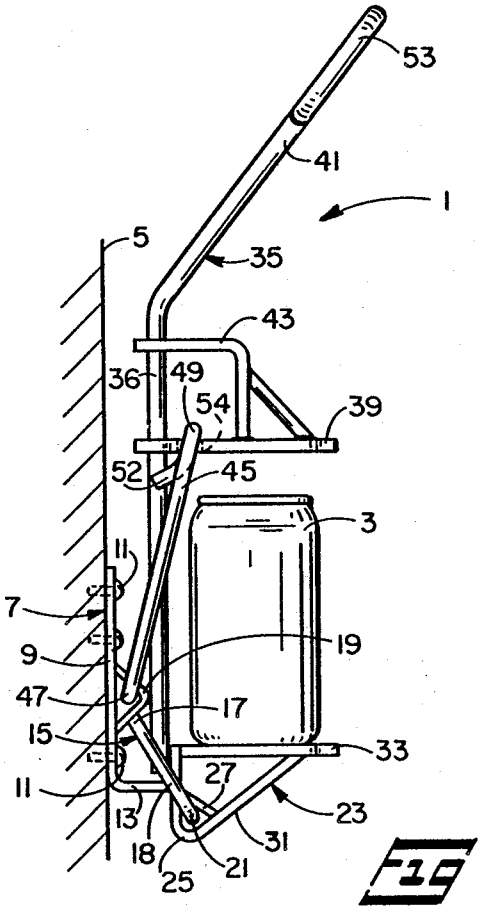
FIG. 1 is a side view of the present invention shown in an open configuration for receiving an object to be crushed.

The link 45 is dimensioned such that when the handle 35 is in the upright position of FIGS. 1 and 2, the top and bottom plates 39 and 33, respectively, are vertically spaced apart to place the crusher 1 in an open configuration. The distance between the top and bottom plates in the open configuration is such that a conventional beverage can 3 or other selected object can be inserted between them, with the can resting on the bottom plate 33. By gripping the hand grip 53, the handle 35, support 23, and base bottom plate 33 can be rotated clockwise with respect to FIG. 1 about the first axis 14.

Figure 3:
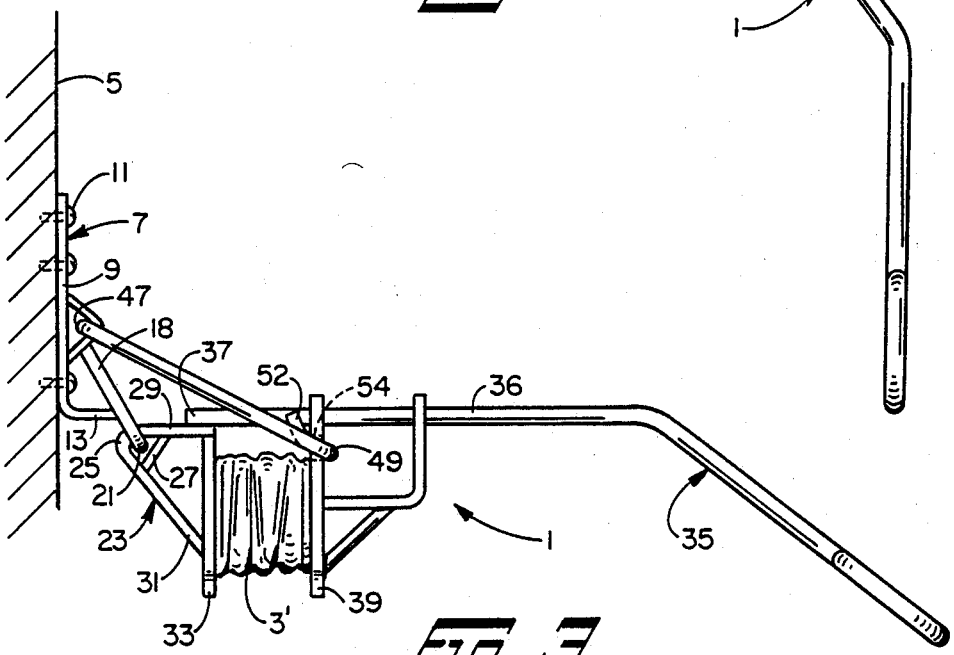
FIG. 3 is a side view of the crusher of the present invention shown in a closed configuration with a crushed object.

As the handle 35 approaches the generally horizontal position of FIG. 3, the plane of the bottom plate 33 approaches a vertical attitude. Simultaneously, the bottom plate rotates away from the second axis 48. The rotation of the handle about the loop end 21 also causes the top plate 39 to revolve about the first axis 14 toward a generally vertical attitude. The distance between the top plate 39 and the second axis 48 is fixed by the link 45. Consequently, as the handle rotates clockwise, the link forces the top plate to slide along the handle toward the bottom plate and cause the crusher 1 to approach a closed configuration. In the closed configuration, the top and bottom plates are spaced apart a relatively small distance. The result is that the can 3 is crushed axially between the top and bottom plates into a minimum volume slug 38' as the crusher is operated from the open to the closed configurations. The quarter-inch spacing between the bends of the link angled free end sections 52 and the top plate, plus the relatively large size of the clearance holes 54, enable the crusher to operate smoothly and without binding.

With the crusher 1 approximately in the configuration of FIG. 3, the slug 3' is in a generally fully crushed condition. Continued clockwise rotation of the handle 35 about the first axis 14 can continue until the crusher attains a fully closed configuration and crushes the slug 3' to the full extent. To automatically remove the slug from between the top and bottom plates 33 and 39, respectively, the person operating the crusher need only rotate the handle in the counterclockwise direction relative to FIG. 3. Even a slight counterclockwise rotation causes the top and bottom plates to separate, and the slug is released from between the two plates. Consequently, the slug drops by gravity from between the plates into a container, not shown, waiting below the crusher. In that manner, the person does not have to handle the compacted slugs. Rotating the handle counterclockwise back to the position of FIGS. 1 and 2 opens the plates 33 and 39 to accept another can 3 for compacting.

Figure 4:
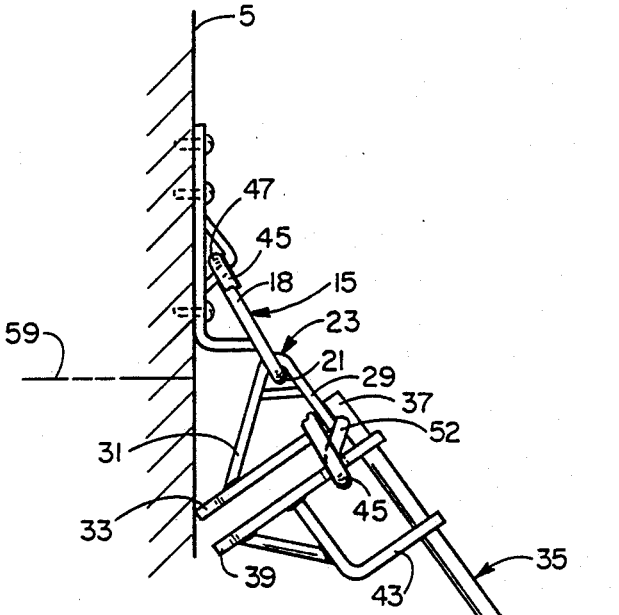
FIG. 4 is a side view of the crusher of the present invention shown in a rest configuration.

Further in accordance with the present invention, the crusher automatically assumes a stable and safe condition when not in use. Looking at FIG. 4, the crusher is shown in a rest configuration. In the rest configuration, the center of gravity of the handle 35, support 23, top plate 39, and bottom plate 33 is at the lowest possible point below the first axis 14 consistent with the particular installation. In the installation shown in FIG. 4, the rest configuration is attained when the bottom plate 33 rotates to contact the vertical mounting surface 5. The crusher is sufficiently versatile such that it can be mounted to a vertical surface that ends at a typical location 59 slightly below the base member 7. In that type of installation, the handle, support, top plate, and bottom plate will dangle generally vertically below the loop closed end 21 when the crusher is in the rest configuration. In either installation, the crusher is in a position of maximum stability. When not in use, therefore, the crusher cannot accidentally fall from a more open position. Nearby persons are thus protected from injury that could occur if the crusher were stored such that the center of gravity of the rotatable handle, support, and plates were located above the axis 14.

Thus, it is apparent that there has been provided, in accordance with the invention, a crusher that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A crusher comprising:

a. base means for defining first and second axes having a first predetermined spacing therebetween;

b. support means for selectively rotating about the base means first axis;

c. handle means having a longitudinal axis and a first end fixed to the support means and a second end for having an external force applied thereto to cause the handle means and support means to rotate about the first axis;

d. a generally planar top plate slidingly received on the handle means and lying in a plane generally perpendicular to the handle longitudinal axis; and e. link means pivotable about the base means second axis for controlling the sliding of the top plate on the handle means in response to the rotation of the handle means and support means about the base means first axis, the link means causing the top plate to slide toward the support means when the handle means and support means are rotated about the base means first axis under the external force applied to the handle means second end, so that the top plate approaches the support means to crush an object placed therebetween when the handle means and support means are rotated about the base means first axis.

2. The crusher of claim 1 wherein the support means comprises:

a. a generally V-shaped support having a crook rotatably captured over the base means for rotating about the first axis defined thereby and free ends; and b. a generally planar bottom plate joined to the support free ends and being spaced a predetermined distance from the first axis and being generally parallel to the top plate.

3. The crusher of claim 1 wherein the link means comprises:

a. a first end captured in the base means to pivot about the base means second axis; and b. a second end pivotally received in the top plate, the link means first and second ends being spaced apart a distance greater than the first predetermined spacing between the base means first and second axes.

4. Apparatus for crushing an object comprising:

a. base means for mounting to a selected substantially planar fixed surface;

b. support means mounted to the base means for rotating about a first axis;

c. handle means having a first end joined to the support means and a second end for receiving an external force to cause the handle means and support means to rotate about the first axis between a first position and a second position; and d. plate means for sliding along the handle means in response to rotation of the handle means by the external force between a first location where the plate means is spaced from the support means when the handle means is in the first position to receive the object between the support means and the plate means and a second location where the plate means is proximate the support means when the handle means is in the second position, so that the object is crushed between the support means and the plate means as the handle means is rotated from the first to the second position thereof.

5. The apparatus of claim 4 wherein:

a. the base means defines the first axis and a second axis at a predetermined spacing from the first axis; and b. the plate means comprises:

i. a plate slidingly received on the handle means; and ii. a link having a first end pivotally received in the plate and a second end pivotally received in the base means for pivoting about the second axis, the link first and second ends being spaced apart a distance greater than the predetermined spacing between the first and second axes of the base means, the link controlling the sliding of the top plate along the handle means when the handle means is rotated between the first and second positions thereof such that the base means first axis is located generally between the base means second axis and the link first end when the handle means is in the second position thereof.

6. The apparatus of claim 4 wherein the plate means is in the first location thereof when the handle means is in an attitude that is generally parallel to the fixed surface, and wherein the plate means is in the second location thereof when the handle means is in an attitude that is generally perpendicular to the fixed surface.

7. The apparatus of claim 6 wherein:

a. the base means is mounted to a fixed surface that is generally vertical;

b. the handle means, plate means, and support means are located at an elevation higher than the first axis when the handle means is in the first position; and c. the handle means and support means are pivotable about the first axis to a rest configuration wherein the center of gravity of the handle means, support means, and plate means is located at an elevation lower than the first axis.

8. The apparatus of claim 4 wherein:

a. the base means defines a second axis spaced at a predetermined distance from the first axis; and b. the support means comprises:

i. a generally V-shaped support having a crook captured for rotation about the base means first axis and free ends that terminate at a predetermined distance from the first axis; and ii. a bottom plate attached to the free ends of the V-shaped support for rotation therewith in an arc at the predetermined distance from the first axis, the bottom plate rotating away from the second axis when the handle means is rotated from the first to the second positions thereof, the bottom plate cooperating with the plate means to crush the object when the handle means is rotated from the first to the second positions thereof.

9. A crusher comprising:

a. a base member defining spaced apart first and second axes;

b. support means captured on the base member for rotation about the first axis;

c. an elongated handle having a longitudinal axis and a first end fixed to the support means and a second end for receiving an external force to rotate the handle and support means about the first axis;

d. a generally planar top plate slideably received on the handle; and e. a link having a first end pivotally received in the top plate and a second end captured on the base member for pivoting about the second axis, the link first and second ends being spaced apart a distance greater than the distance between the base member first and second axes, the link controlling the top plate to slide along the handle in response to handle rotation about the first axis.

10. The crusher of claim 9 wherein the crusher is operable between an open configuration where the handle is at a first position and the link controls the top plate to slide away from the first axis to a location remote from the support means and whereat the base member second axis is generally between the base member first axis and the link first end, and a closed configuration where the handle is at a second position and the link controls the top plate to slide toward the first axis to a location proximate the support means and whereat the base member first axis is generally between the base member second axis and the link first end, so that an object placed between the top plate and support means when the crusher is in the open configuration is crushed when the handle is rotated to place the crusher in the closed configuration.

11. The crusher of claim 10 wherein:

a. the support means comprises a support captured on the base member for rotation about the first axis and a generally planar bottom plate generally parallel to and at a predetermined distance from the first axis and joined to the support, the plane of the bottom plate being generally parallel to the plane of the top plate; and b. the bottom plate and the handle rotate away from the base member second axis when the handle rotates from the first position to the second position thereof.

12. The crusher of claim 11 wherein:

a. the base member is mounted to a fixed surface that is generally vertical; and b. the handle longitudinal axis is generally parallel to the vertical surface and the planes of the top and bottom plates are generally perpendicular to the vertical surface when the crusher is in the open configuration, and wherein the handle is generally perpendicular to the vertical surface and the top and bottom plates are generally parallel to the vertical surface when the crusher is in the closed configuration.

13. A can crusher mounted to a vertical surface comprising:

a. a base mounted to the vertical surface and lying in a generally vertical plane, the base defining spaced apart first and second axes, the second axis being located at an elevation higher than the first axis;

b. a generally planar support plate mounted for rotation about the base first axis;

c. an elongated handle having a longitudinal axis that is generally perpendicular to the plane of the support plate and a first end fixed to the support plate and a second end for selectively receiving an external force to rotate the handle and the support plate about the first axis between a first position whereat the handle longitudinal axis is generally parallel to the vertical surface and the second position whereat the handle longitudinal axis is generally perpendicular to the vertical surface;

d. a top plate slideably captured on the handle and lying in a plane generally perpendicular to the handle longitudinal axis; and e. a link having a first end pivotally received in the base for rotation about the second axis thereof and a second end pivotally received in the top plate, the link first and second ends being spaced apart a distance greater than the spacing between the base first and second axes, the link controlling the sliding of the top plate on the handle when the handle is rotated about the base first axis such that the link causes the top plate to slide along the handle toward the support plate when the handle is rotated from the first to the second positions thereof to thereby crush a can placed between the top plate and the support plate.

14. The can crusher of claim 13 wherein the handle is rotatable to a rest position whereat the link second end is generally collinear with the base first and second axes and the base first axis lies generally between the link second end and the base second axis, so that the link and top plate are operated in an overcenter toggle action relative to the base first and second axes and to the support plate when the handle is operated from the first position to the rest position.

* * * * *